US007798336B2

(12) United States Patent
Shiao

(10) Patent No.: US 7,798,336 B2
(45) Date of Patent: Sep. 21, 2010

(54) MAGNETIC TOOL STORAGE RACK

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 699 days.

(21) Appl. No.: 11/734,832

(22) Filed: Apr. 13, 2007

(65) Prior Publication Data

US 2008/0251476 A1 Oct. 16, 2008

(51) Int. Cl.
*A47F 7/00* (2006.01)

(52) U.S. Cl. ..... 211/70.6; 211/DIG. 1

(58) Field of Classification Search ..... 211/126.16, 211/312.1, 135, 69, 70.1, 88.01, 88.02, 90.01, 211/90.02, 70.8, 70.6, 132.1; 248/309.4, 248/683, 206.5; 108/65, 69, 89, 102, 137, 108/143, 54.1, 42; 312/205, 245; 206/372, 206/373, 379, 118, 350; 294/65.5; D6/567; 81/129.5; 269/8
See application file for complete search history.

(56) References Cited

U.S. PATENT DOCUMENTS 1,697,711 A * 1/1929 Brown ..... 211/88.01
2,954,257 A * 9/1960 Besuch et al. ..... 248/206.5
2,966,992 A * 1/1961 Dunkelberger et al. ..... 211/70.7
3,229,820 A * 1/1966 Hentzi et al. ..... 211/70.6
4,036,369 A * 7/1977 Eisenberg ..... 211/88.02
4,155,312 A * 5/1979 Thorkildson ..... 108/137
4,586,616 A * 5/1986 Cooper et al. ..... 211/88.04
4,591,817 A * 5/1986 Miller ..... 335/285
4,802,595 A * 2/1989 Northington ..... 211/88.02
4,813,551 A * 3/1989 Kuo ..... 211/70.6
5,020,293 A * 6/1991 Itagaki ..... 52/314
5,137,160 A * 8/1992 Santucci ..... 211/153
5,316,143 A * 5/1994 Horn ..... 206/378
5,398,900 A * 3/1995 Schober ..... 248/251
5,487,475 A * 1/1996 Knee ..... 211/70.8
5,553,824 A * 9/1996 Dutra, Jr. ..... 248/346.07
5,988,408 A * 11/1999 Evans et al. ..... 211/70.6
6,006,906 A * 12/1999 Winnard ..... 206/350
6,216,888 B1 * 4/2001 Chien ..... 211/87.01
6,234,328 B1 * 5/2001 Mason ..... 211/90.02
6,571,966 B1 * 6/2003 Hsiao ..... 211/70.6
6,614,337 B1 * 9/2003 Winnard ..... 335/285
6,877,826 B2 * 4/2005 Wood et al. ..... 312/205
D575,972 S * 9/2008 Shiao ..... D6/567
7,591,385 B2 * 9/2009 Brooks ..... 211/94.01
D602,724 S * 10/2009 Liu ..... D6/567
2003/0038100 A1 * 2/2003 Liu ..... 211/88.01
2004/0144739 A1 * 7/2004 Marek ..... 211/70.6
2007/0114195 A1 * 5/2007 Patsalaridis ..... 211/85.29

* cited by examiner

*Primary Examiner*—Darnell M Jayne
*Assistant Examiner*—Andres Gallego
(74) *Attorney, Agent, or Firm*—Ladas & Parry LLP

(57) ABSTRACT

A magnetic tool storage rack includes a main rack body having a positioning wall, and a magnetic assembly. The magnetic assembly includes a fixing unit and a magnet unit. The fixing unit is installed on the positioning wall and is made from a non-magnetic material. The fixing unit defines a receiving space, and has an opening formed in one side opposite to the positioning wall and in spatial communication with the receiving space. The magnet unit includes at least two magnet components, each of which is disposed in the receiving space, has a wall contacting part that extends through the opening in the fixing unit, and is movable linearly in the receiving space in directions toward and away from the positioning wall of the main rack body to result in a variable length of the wall contacting part that extends through the opening.

10 Claims, 5 Drawing Sheets

MAGNETIC TOOL STORAGE RACK

BACKGROUND OF THE INVENTION

1. Field of the Invention

The invention relates to a tool storage rack, more particularly to a magnetic tool storage rack that has an expandable storage capacity and that can be mounted firmly to an uneven metal wall surface.

2. Description of the Related Art

U.S. Pat. No. 5,743,416 discloses a conventional tool rack for storing hand tools. However, the storage capacity of the conventional tool rack is fixed and cannot be expanded as needed. U.S. Pat. Nos. 6,571,966 B1 and D487,193 S disclose a kind of conventional magnetic tool storage rack that can be mounted to a metal wall by virtue of magnetic attraction. However, the storage capacity of the conventional magnetic tool rack disclosed therein is also not expandable. Besides, since a magnetic unit is secured to a relatively long flat back side of the tool storage rack, the conventional magnetic tool storage rack may not be firmly mounted to an uneven metal wall surface, thereby limiting the range of application.

SUMMARY OF THE INVENTION

Therefore, the object of the present invention is to provide a magnetic tool storage rack that has an expandable storage capacity and that can be mounted firmly to an uneven metal wall surface.

According to one aspect of the invention, a magnetic tool storage rack comprises a main rack body adapted for holding hand tools and having a positioning wall, and a magnetic assembly. The magnetic assembly includes a fixing unit and a magnet unit. The fixing unit is installed on the positioning wall and is made from a non-magnetic material. The fixing unit defines a receiving space, and has an opening formed in one side opposite to the positioning wall and in spatial communication with the receiving space. The magnet unit includes at least two magnet components, each of which is disposed in the receiving space, has a wall contacting part that extends through the opening in the fixing unit, and is movable linearly in the receiving space in directions toward and away from the positioning wall of the main rack body to result in a variable length of the wall contacting part that extends through the opening.

According to another aspect of the invention, a magnetic tool storage rack comprises a main rack body, a tool holding tray, and a magnetic assembly. The main rack body includes a positioning wall that has opposite first and second sides, and a supporting wall that extends from the first side of the positioning wall and that is formed with a plurality of first tool holding holes. The tool holding tray is movably disposed on the supporting wall, is formed with a plurality of second tool holding holes, and is movable relative to the main rack body between a non-expanded position, where the second tool holding holes are aligned with the first tool holding holes such that hand tools are capable of being extended through aligned ones of the first and second tool holding holes, and an expanded position, where the tool holding tray exposes a part of the supporting wall formed with a portion of the first tool holding holes for extension of a first set of the hand tools therethrough, and where the supporting wall uncovers a part of the tool holding tray formed with a portion of the second tool holding holes for extension of a second set of the hand tools therethrough. The magnetic assembly is mounted to the second side of the positioning wall.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
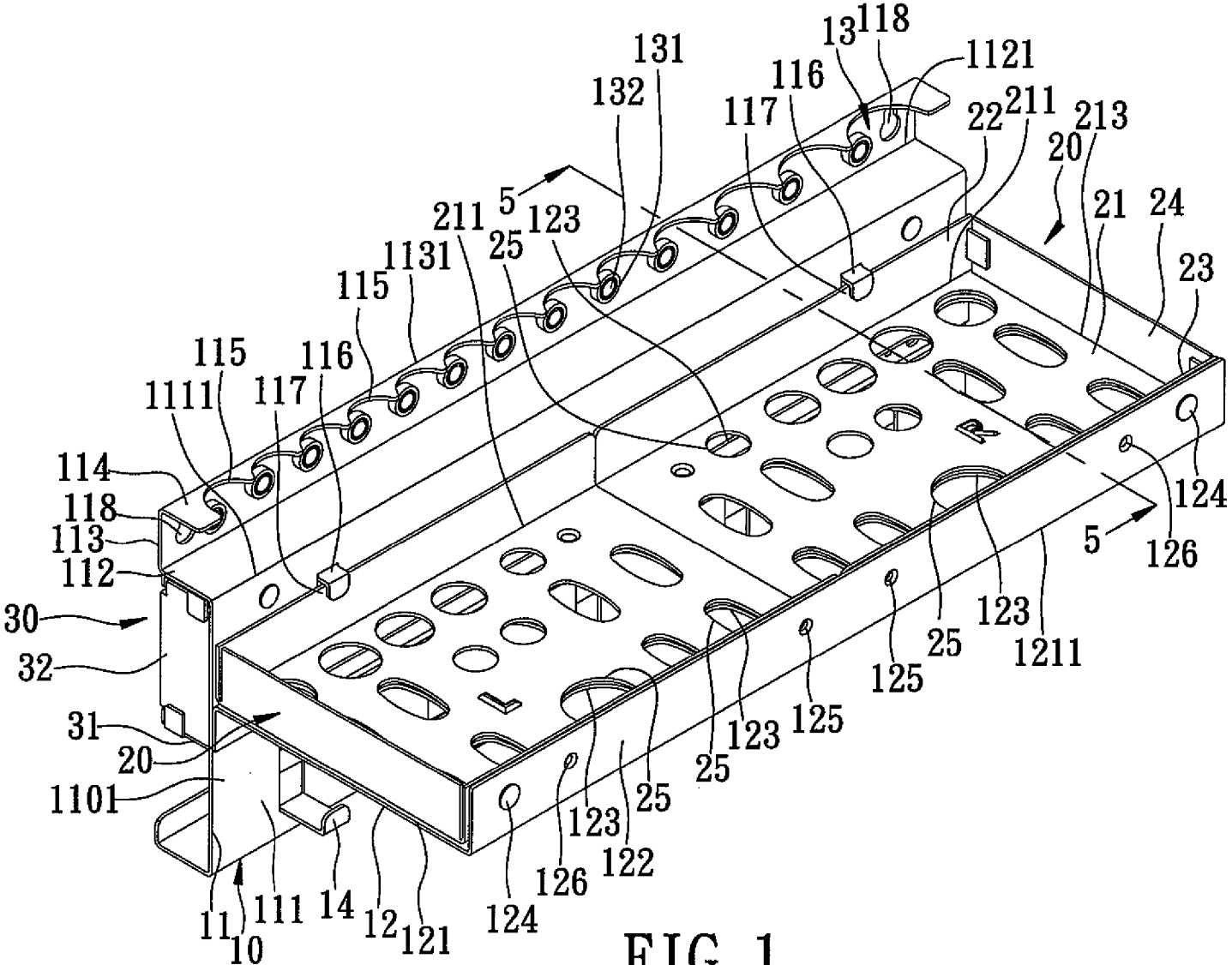
FIG. 1 is an assembled front perspective view of a preferred embodiment of a magnetic tool storage rack according to the invention, illustrating a pair of tool holding trays at a non-expanded position.
Figure 2:
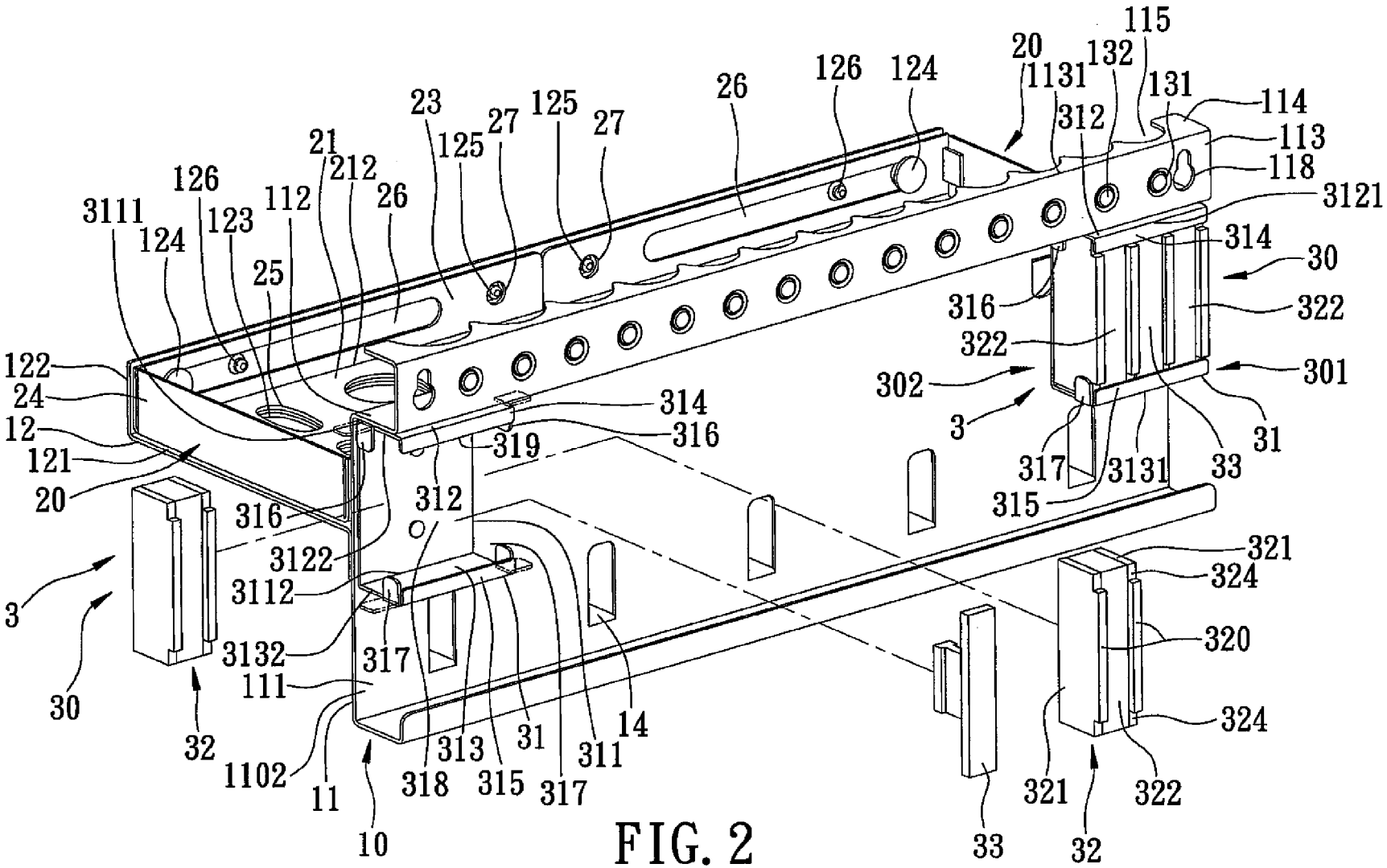
FIG. 2 is a partly exploded rear perspective view of the preferred embodiment.
Figure 3:
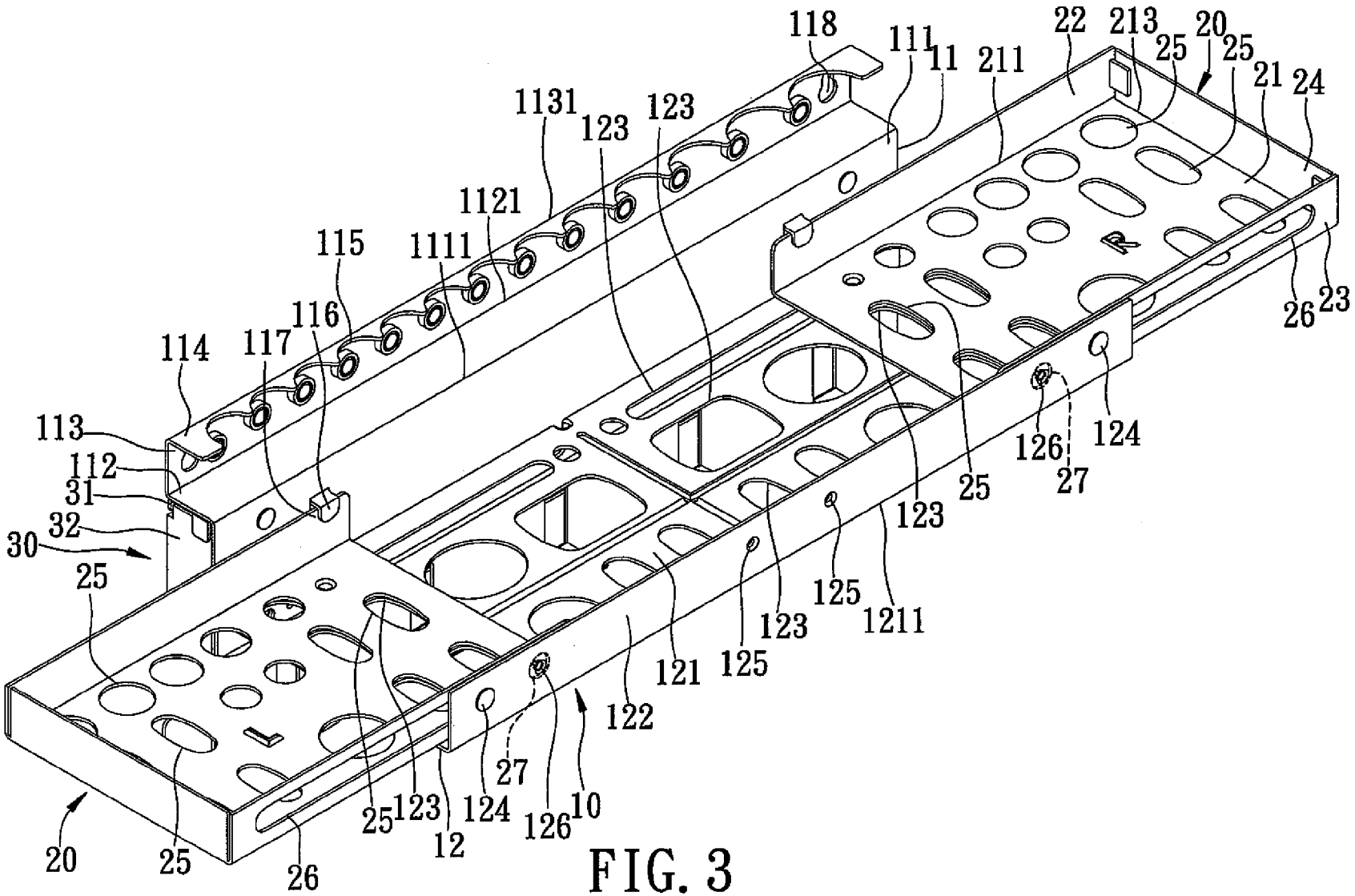
FIG. 3 is a view similar to FIG. 1, but illustrating the tool holding trays at an expanded position.

As shown in FIGS. 1 to 3, the preferred embodiment of a magnetic tool storage rack according to the present invention includes a main rack body 10, a pair of tool holding trays 20, and a magnetic assembly 3.

The main rack body 10 includes a positioning wall 11 that has opposite first and second sides 1101, 1102, and a supporting wall 12 that extends from the first side 1101 of the positioning wall 11 and that is formed with a plurality of first tool holding holes 123.

The positioning wall 11 includes an upright wall portion 111 from which the supporting wall 12 extends and that has a first top edge 1111, a top wall portion 112 that extends from the first top edge 1111 of the upright wall portion 111 in a direction opposite to the supporting wall 12 and that has a first distal edge 1121, a wall mounting portion 113 that extends upwardly from the first distal edge 1121 of the top wall portion 112 and that has a second top edge 1131, and a socket holding portion 114 that extends from the second top edge 1131 of the wall mounting portion 113, that is disposed above the top wall portion 112, and that is formed with a plurality of socket holding notches 115.

The main rack body 10 further includes a socket attracting magnet unit 13 mounted on the wall mounting portion 113 of the positioning wall 11. In this embodiment, the socket attracting magnet unit 13 includes a plurality of collars 131 formed in the wall mounting portion 113 at positions corresponding to the socket holding notches 115, and a plurality of second magnets 132 disposed respectively in the collars 131, such that different sizes of sockets can be retained in the socket holding notches 115 by virtue of the second magnets 132. The wall mounting portion 113 is further formed with a pair of hanging holes 118 disposed respectively at two sides of the plurality of the socket holding notches 115. The positioning wall 11 further includes a plurality of hooks 14 that extend from the upright wall portion 111 and that are disposed under the supporting wall 12 for hanging hand tools.

The supporting wall 12 includes a bottom wall portion 121 that extends from the positioning wall 11, that is formed with the first tool holding holes 123, and that has a second distal edge 1211 opposite to the positioning wall 11, and a front wall portion 122 that extends upwardly from the second distal edge 1211.

Each of the tool holding trays 20 is movably disposed on the supporting wall 12, is formed with a plurality of second tool holding holes 25, and is movable relative to the main rack body 10 between a non-expanded position (see FIGS. 1 and 2), where the second tool holding holes 25 are aligned with the first tool holding holes 123 such that hand tools are capable of being extended through aligned ones of the first and second tool holding holes 123, 25, and an expanded position (see FIG. 3) where the tool holding tray 20 exposes a part of the supporting wall 12 formed with a portion of the first tool holding holes 123 for extension of a first set of the hand tools therethrough, and where the supporting wall 12 uncovers a part of the tool holding tray 20 formed with a portion of the second tool holding holes 25 for extension of a second set of the hand tools therethrough. Each of the tool holding trays 20 includes a bottom wall 21 that is formed with the second tool holding holes 25 and that has opposite inner and outer edges 211, 212, and a side edge 213 opposite to the other one of the tool holding trays 20. The tool holding tray 20 further includes an inner wall 22 that extends upwardly from the inner edge 211 of the bottom wall 21 and that is disposed adjacent to the positioning wall 11 of the main rack body 10, an outer wall 23 that extends upwardly from the outer edge 212 of the bottom wall 21 and that is disposed adjacent to the front wall portion 122 of the supporting wall 12, and a side wall 24 that extends upwardly from the side edge 213 of the bottom wall 21 and that is disposed between the inner and outer walls 22, 23.

The positioning wall 11 of the main rack body 10 is formed with a pair of limiting tabs 116, each of which extends above the inner wall 211 of a respective one of the tool holding trays 20, and defines a slide groove 117 through which the inner wall 211 slidably extends. The outer wall 23 of each of the tool holding trays 20 is formed with an elongated guide slot 26, and the front wall portion 122 of the supporting wall 12 is formed with a pair of guide pins 124. Each of the guide pins 124 extends from the front wall portion 122 into the guide slot 26 in a respective one of the tool holding trays 20 to guide sliding movement of the tool holding tray 20 on the supporting wall 12.

The front wall portion 122 of the supporting wall 12 is further formed with a pair of first positioning protrusions 125 and a pair of second positioning protrusions 126. The second positioning protrusions 126 are spaced apart from each other and are disposed between and are adjacent to the guide pins 124 of the supporting wall 12, respectively. The first positioning protrusions 125 are spaced apart from each other and are disposed between the second positioning protrusions 126. The outer wall 212 of each of the tool holding trays 20 is formed with a positioning hole 27. The positioning holes 27 in the tool holding trays 20 engage the first positioning protrusions 125 respectively when the tool holding trays 20 are at the non-expanded position and engage the second positioning protrusions 126 respectively when the tool holding trays 20 are at the expanded position.

The magnetic assembly 3 includes a fixing unit 301 and a magnet unit 302. The fixing unit 301 is installed on the positioning wall 11 of the main rack body 10, and is made from a non-magnetic material. The fixing unit 301 includes a pair of fixing seats 31, and the magnetic unit 302 includes four magnet components 32. Each of the fixing seats 31 defines a receiving space 318, has an opening 319 formed in one side opposite to the positioning wall 11 and in spatial communication with the receiving space 318, and receives two of the magnet components 32 in the receiving space 318 to form a magnetic mounting set 30. The magnetic mounting sets 30 are provided spacedly on one surface of the positioning wall 11 of the main rack body 10 opposite to the supporting wall 12, i.e., the second side 1102 of the positioning wall 11.

Each of the fixing seats 31 includes an upright wall 311 mounted to the positioning wall 11 of the main rack body 10 and having opposite first and second edges 3111, 3112, a first side wall 312 extending from the first edge 3111 of the upright wall 311 away from the positioning wall 11, and a second side wall 313 extending from the second edge 3112 of the upright wall 311 away from the positioning wall 11. The upright wall 311 and the first and second side walls 312, 313 cooperate to define the receiving space 318 of a corresponding one of the fixing seats 31. The first side wall 312 has a first distal end 3121 opposite to the upright wall 311 and formed with a first limiting flange 314 that extends toward the second side wall 313. The second side wall 313 has a second distal end 3131 opposite to the upright wall 311, and formed with a second limiting flange 315 that extends toward the first side wall 312 and that cooperates with the first limiting flange 314 to define the opening 319 in the corresponding one of the fixing seats 31. The first side wall 312 further has a pair of first side ends 3122 between the first edge 3111 of the upright wall 311 and the first distal end 3121, which are formed with a pair of first retaining pieces 316, respectively. The second side wall 313 further has a pair of second side ends 3132 between the second edge 3112 of the upright wall 311 and the second distal end 3131, which are formed with a pair of second retaining pieces 317, respectively. The first and second retaining pieces 316, 317 cooperate to retain the magnet components 32 in the receiving space 318 of the corresponding one of the fixing seats 31.

Figure 4:
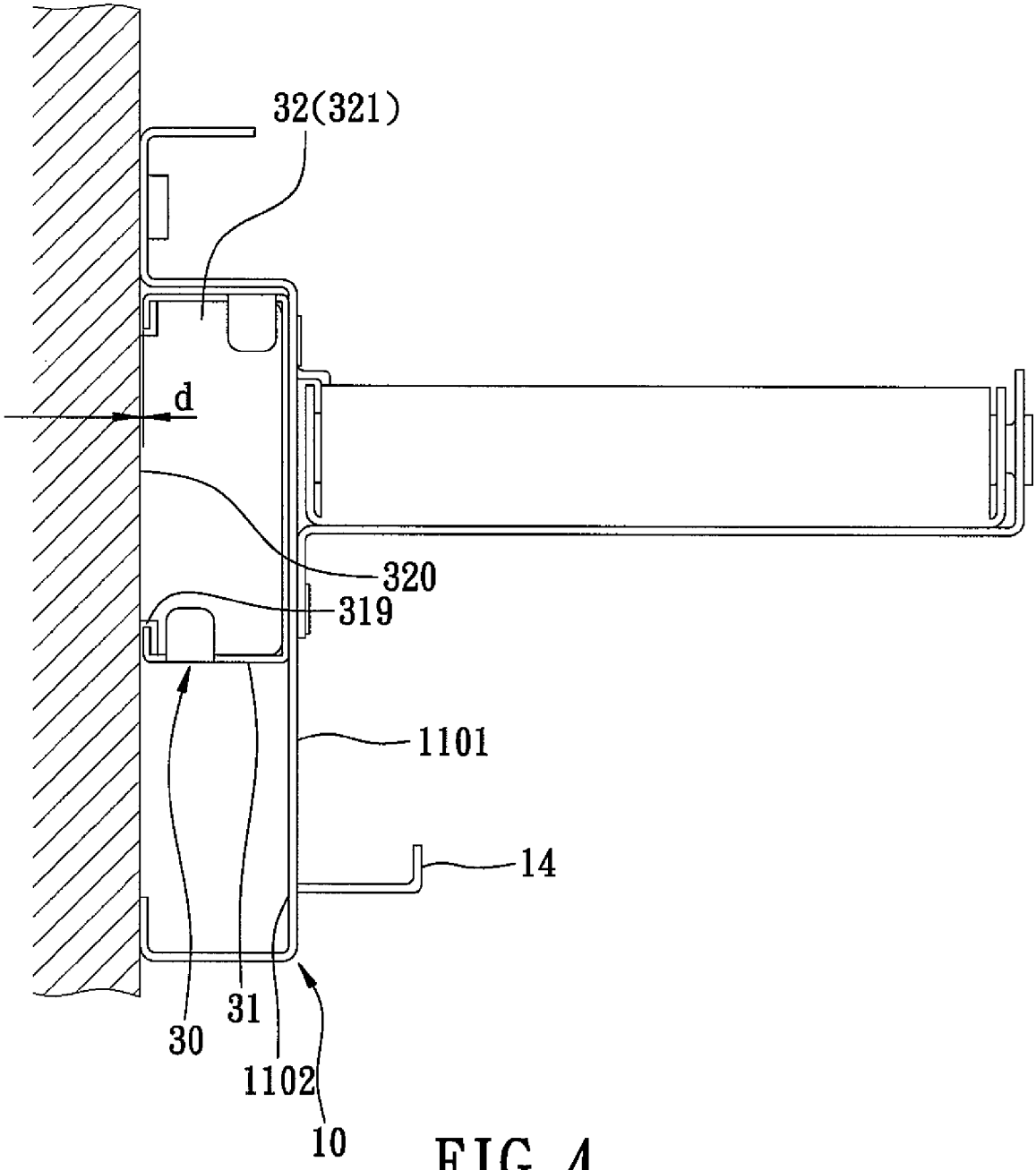
FIG. 4 is a schematic side view of the preferred embodiment, illustrating a magnet component that is mounted to a wall with a minimum length of a wall contacting part.
Figure 5:
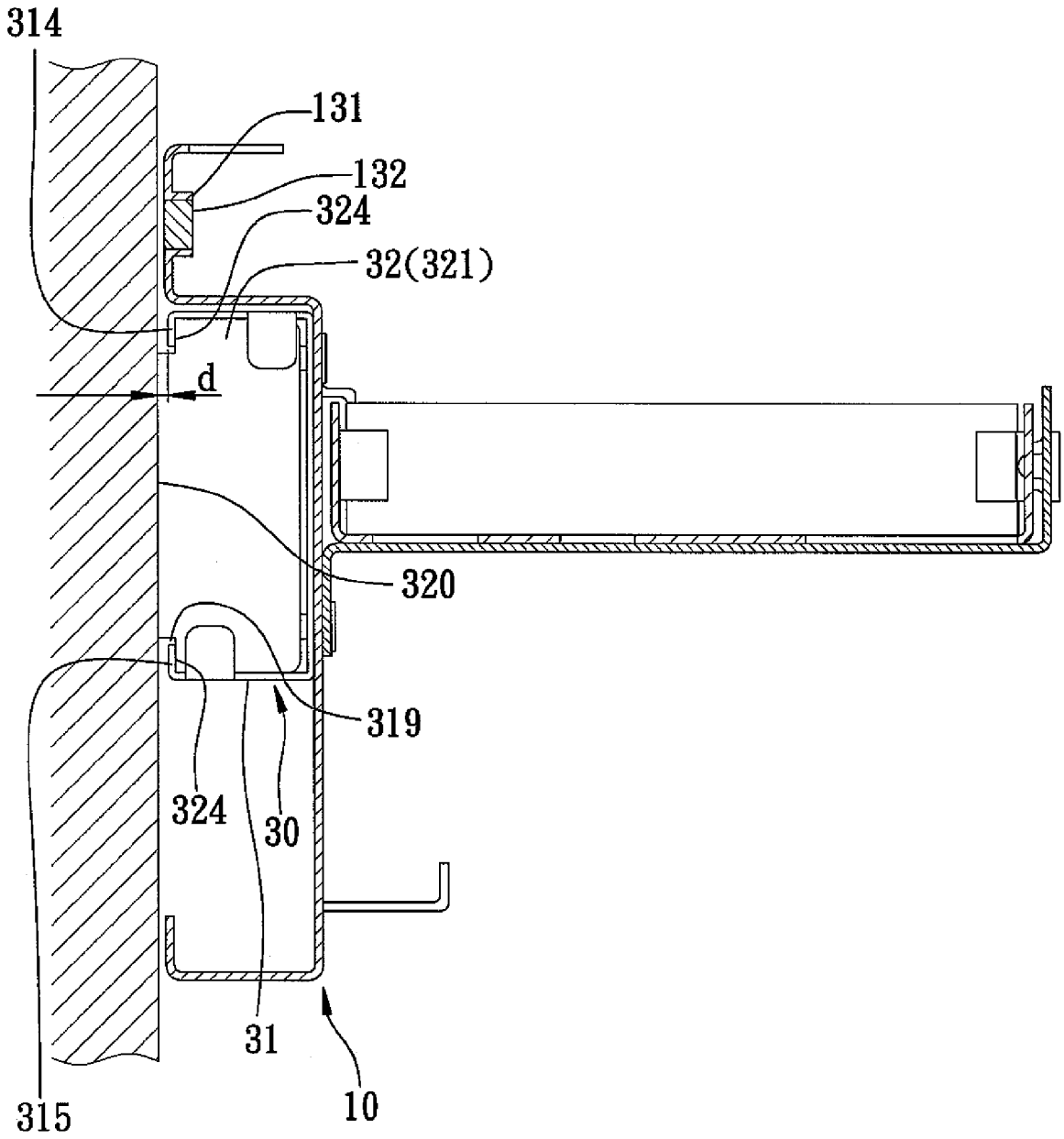
FIG. 5 is a sectional view of the preferred embodiment taken along line 5-5 in FIG. 1, illustrating the magnet component that is mounted to the wall with a maximum length of the wall contacting part.

Each of the magnet components 32 has a wall contacting part 320 that extends through the opening 319 in the fixing unit 301, and is movable linearly in the receiving space 319 in directions toward and away from the positioning wall 11 of the main rack body 10 to result in a variable length (d) of the wall contacting part 320 that extends through the opening 319, as best shown in FIGS. 4 and 5. In this embodiment, each of the magnet components 32 includes a pair of spaced apart magnetically conductive sheets 321 and a first magnet 322 disposed between the magnetically conductive sheets 321. Each of the magnetically conductive sheets 321 has one side that is opposite to the upright wall 311 of a respective one of the fixing seats 31, that is defined as the wall contacting part 320, and that is formed with a pair of shoulder portions 324 registered respectively with the first and second limiting flanges 314, 315 of the first and second side walls 312, 313 of the respective one of the fixing seats 31. The shoulder portions 324 abut against the first and second limiting flanges 314, 315 respectively when a largest extended length (d) of the wall contacting part 320 extends through the opening 319, as best shown in FIG. 5. Each of the magnetic mounting sets 30 further includes a spacer component 33 disposed in the receiving space 318 of the respective fixing seat 31 between the pair of the magnet components 32 in the respective fixing seat 31.

As shown in FIGS. 2, 4, and 5, the main rack body 10 can be mounted to a metal wall through the magnetism of the magnetic mounting sets 30. Since the magnet components 32 of each of the magnetic mounting sets 30 are movable linearly relative to the corresponding fixing seat 31, each of the magnetic mounting sets 30 can be coupled to a wall with the wall contacting part 320 in full contact with the wall surface, even if the wall surface is uneven. For example, when the preferred embodiment is mounted to the wall, the magnet components 32 of one of the magnetic mounting seats 30 may be coupled to a relatively protruding spot of the wall with a minimum extended length (d) of the wall contacting part 320 through the opening 319 (see FIG. 4). Meanwhile, the magnet components 32 of the other of the magnetic mounting seats 30 may be coupled to a relatively recessed spot of the wall with a maximum extended length (d) of the wall contacting part 320 through the opening 319 (see FIG. 5). Therefore, the present invention is suitable for being mounted firmly to an uneven wall surface by virtue of the movable magnetic components 32.

Moreover, the storage capacity of the present invention is adjustable to accommodate a fewer number of hand tools when the tool holding trays 20 are moved to the non-expanded position, and to accommodate a greater number of hand tools when the tool holding trays 20 are moved to the expanded position.

It should be noted that, while this invention is exemplified using a pair of shoulder portions 324 to be registered respectively with first and second limiting flanges 314, 315, only one shoulder portion 324 to be registered with only one limiting flange 314 or 315 may be employed in other embodiments of this invention if the length of the limiting flange is long enough to limit the corresponding magnet components 32 within the receiving space 318.

Moreover, while in this preferred embodiment, the limiting tabs 116 are formed on the positioning wall 11, the guide pins 124 are formed on the front wall portion 122 of the supporting wall 12 to extend into the guide slots 26 that are formed respectively in the tool holding trays 20, and the positioning holes 27 are formed in the outer walls 212 of the tool holding trays 20 to engage the first and second positioning protrusions 125, 126 that are formed on the front wall portion 122, the disposition of the same should not be limited thereto as long as, when the tool holding trays 20 are moving between the non-expanded and the expanded positions, the tool holding trays 20 are able to move horizontally on the supporting wall 12 without slanting, and are able to be retained relative to the main rack body 10 at the non-expanded and expanded positions.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A magnetic tool storage rack comprising:

a main rack body including a positioning wall that has opposite first and second sides, and a supporting wall that extends from said first side of said positioning wall and that is formed with a plurality of first tool holding holes;

a tool holding tray movably disposed on said supporting wall, formed with a plurality of second tool holding holes, and movable relative to said main rack body between a non-expanded position, where said second tool holding holes are aligned with said first tool holding holes such that hand tools are capable of being extended through aligned ones of said first and second tool holding holes, and an expanded position, where said tool holding tray exposes a part of said supporting wall formed with a portion of said first tool holding holes for extension of a first set of the hand tools therethrough, and where said supporting wall uncovers a part of said tool holding tray formed with a portion of said second tool holding holes for extension of a second set of the hand tools therethrough; and a magnetic assembly mounted to said second side of said positioning wall;

wherein said positioning wall of said main rack body includes an upright wall portion from which said supporting wall extends, and having a first top edge, a top wall portion extending from said first top edge of said upright wall portion in a direction opposite to said supporting wall, and having a first distal edge, a wall mounting portion extending upwardly from said first distal edge of said top wall portion, and having a second top edge, and a socket holding portion extending from said second top edge of said wall mounting portion, disposed above said top wall portion, and formed with a plurality of socket holding notches.

2. The magnetic tool storage rack as claimed in claim 1, wherein said main rack body further includes a socket attracting magnet unit mounted on said wall mounting portion.

3. The magnetic tool storage rack as claimed in claim 2, wherein said socket attracting magnet unit includes a plurality of collars formed in said wall mounting portion at positions corresponding to said socket holding notches, and a plurality of second magnets disposed in said collars, respectively.

4. The magnetic tool storage rack as claimed in claim 1, wherein said wall mounting portion is further formed with a pair of hanging holes disposed respectively at two sides of said plurality of said socket holding notches.

5. The magnetic tool storage rack as claimed in claim 1, wherein said positioning wall further includes a hook that extends from said upright wall portion and that is disposed under said supporting wall.

6. The magnetic tool storage rack as claimed in claim 1, wherein:

said supporting wall includes a bottom wall portion that extends from said positioning wall, that is formed with said first tool holding holes, and that has a second distal edge opposite to said positioning wall, and a front wall portion that extends upwardly from said second distal edge of said bottom wall portion;

said tool holding tray including a bottom wall that is formed with said second tool holding holes and that has opposite inner and outer edges;

said tool holding tray further including an inner wall that extends upwardly from said inner edge of said bottom wall and that is disposed adjacent to said positioning wall, and an outer wall that extends upwardly from said outer edge of said bottom wall and that is disposed adjacent to said front wall portion of said supporting wall;

wherein said positioning wall is formed with a limiting tab that extends above said inner wall and defines a slide groove through which of said inner wall slidably extends.

7. The magnetic tool storage rack as claimed in claim 1, wherein:

said supporting wall includes a bottom wall portion that extends from said positioning wall, that is formed with said first tool holding holes, and that has a second distal edge opposite to said positioning wall, and a front wall portion that extends upwardly from said second distal edge of said bottom wall portion;

said tool holding tray including a bottom wall that is formed with said second tool holding holes and that has opposite inner and outer edges;

said tool holding tray further including an inner wall that extends upwardly from said inner edge of said bottom wall and that is disposed adjacent to said positioning wall, and an outer wall that extends upwardly from said outer edge of said bottom wall and that is disposed adjacent to said front wall portion of said supporting wall;

wherein said outer wall is formed with an elongated guide slot, and said main rack body further includes at least one guide pin that extends from said front wall portion into said guide slot to guide sliding movement of said tool holding tray on said supporting wall.

8. The magnetic tool storage rack as claimed in claim 1, wherein:

said supporting wall includes a bottom wall portion that extends from said positioning wall, that is formed with said first tool holding holes, and that has a second distal edge opposite to said positioning wall, and a front wall portion that extends upwardly from said second distal edge of said bottom wall portion;

said tool holding tray including a bottom wall that is formed with said second tool holding holes and that has opposite inner and outer edges;

said tool holding tray further including an inner wall that extends upwardly from said inner edge of said bottom wall and that is disposed adjacent to said positioning wall, and an outer wall that extends upwardly from said outer edge of said bottom wall and that is disposed adjacent to said front wall portion of said supporting wall;

wherein said positioning wall is formed with a limiting tab that extends above said inner wall and that defines a slide groove through which said inner wall slidably extends; and wherein said outer wall is formed with an elongated guide slot, and said main rack body further includes a guide pin that extends from said front wall portion into said guide slot to guide sliding movement of said tool holding tray on said supporting wall.

9. The magnetic tool storage rack as claimed in claim 8, wherein said front wall portion is formed with first and second positioning protrusions that are spaced apart from each other, and said outer wall is formed with a positioning hole that engages said first positioning protrusion when said tool holding tray is at the non-expanded position and that engages said second positioning protrusion when said tool holding tray is at the expanded position.

10. The magnetic tool storage rack as claimed in claim 1, wherein one of said main rack body and said tool holding tray is formed with first and second positioning protrusions, and the other of said main rack body and said tool holding tray is formed with a positioning hole that engages said first positioning protrusion when said tool holding tray is at the non-expanded position and that engages said second positioning protrusion when said tool holding tray is at the expanded position.

* * * * *